US010928008B2

(12) United States Patent
Frenal et al.

(10) Patent No.: US 10,928,008 B2
(45) Date of Patent: Feb. 23, 2021

(54) VALVE FOR PRESSURIZED FLUID

(71) Applicant: L'Air Liquide, Société Anonyme pour l'Etude et l'Exploitation des Procédés Georges Claude, Paris (FR)

(72) Inventors: Antoine Frenal, Ezanville (FR); Renaud Ligonesche, Herblay (FR); Olivier Ondo, Palaiseau (FR); Benjamin Fischer, Fresnes (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 105 days.

(21) Appl. No.: 16/318,922

(22) PCT Filed: Jun. 20, 2017

(86) PCT No.: PCT/FR2017/051631
§ 371 (c)(1),
(2) Date: Jan. 18, 2019

(87) PCT Pub. No.: WO2018/015625
PCT Pub. Date: Jan. 25, 2018

(65) Prior Publication Data

US 2019/0242528 A1 Aug. 8, 2019

(30) Foreign Application Priority Data

Jul. 20, 2016 (FR) ..... 1656908

(51) Int. Cl.
*F17C 13/04* (2006.01)

(52) U.S. Cl.
CPC ..... *F17C 13/04* (2013.01); *F17C 2201/0109* (2013.01); *F17C 2201/056* (2013.01);
(Continued)

(58) Field of Classification Search
CPC ..... F17C 13/04; F17C 2265/04; F17C 2201/058; F17C 2223/036;
(Continued)

(56) References Cited

U.S. PATENT DOCUMENTS 4,953,590 A * 9/1990 Kakinunna ..... F02D 41/20 137/554
5,193,580 A 3/1993 Wass et al.
(Continued)

FOREIGN PATENT DOCUMENTS

FR 2868160 9/2005
FR 2970313 7/2012
(Continued)

OTHER PUBLICATIONS

International Written Opinion for corresponding PCT/FR2017/051631, dated Nov. 24, 2017.
(Continued)

*Primary Examiner* — Eric Keasel
(74) *Attorney, Agent, or Firm* — Elwood L. Haynes

(57) ABSTRACT

A valve for a pressurized fluid, including a body housing a fluid circuit including an upstream end configured to be placed in communication with a reserve of pressurized fluid and a downstream end configured to be placed in communication with a receiver apparatus, the circuit including a control member controlling the flow rate in the circuit, said flow rate control member being operated by a mobile actuating member configured to move relative to the body of the valve, the valve including at least a first functional electronic member and a second functional electronic member, the second functional electronic member being mounted removably on the body of the valve.

11 Claims, 4 Drawing Sheets

(52) U.S. Cl.
CPC .. *F17C 2201/058* (2013.01); *F17C 2205/013* (2013.01); *F17C 2205/0326* (2013.01); *F17C 2205/0329* (2013.01); *F17C 2205/055* (2013.01); *F17C 2205/058* (2013.01); *F17C 2223/0123* (2013.01); *F17C 2223/036* (2013.01); *F17C 2250/032* (2013.01); *F17C 2250/034* (2013.01); *F17C 2265/04* (2013.01)

(58) Field of Classification Search
CPC ..... F17C 2201/0109; F17C 2201/056; F17C 2205/013; F17C 2205/0326; F17C 2205/0329; F17C 2205/055; F17C 2205/058; F17C 2223/0123; F17C 2250/032; F17C 2250/034
See application file for complete search history.

(56) References Cited

U.S. PATENT DOCUMENTS 6,019,126 A * 2/2000 Kelada ..... F16K 37/0091 137/493.8
6,185,828 B1 * 2/2001 Schmidt ..... F16K 37/0008 33/1 PT
6,505,642 B2 * 1/2003 Miyazoe ..... F15B 13/0817 137/554
6,520,202 B2 * 2/2003 Miyazoe ..... F15B 13/0402 137/554
7,114,510 B2 * 10/2006 Peters ..... F16K 31/60 137/1
8,342,478 B1 * 1/2013 Cordray ..... F16K 37/0075 137/554
8,622,068 B2 * 1/2014 Bourasseau ..... F17C 13/04 137/15.04
9,116,514 B2 * 8/2015 LaFountain ..... G05B 19/042
2010/0032934 A1 2/2010 Veenstra
2016/0265721 A1 9/2016 Verghade et al.
2017/0122497 A1 5/2017 Bernard

FOREIGN PATENT DOCUMENTS

FR 2991751 12/2013
FR 2998052 5/2014
FR 3019877 10/2015
FR 3022972 1/2016

OTHER PUBLICATIONS

International Search Report for corresponding PCT/FR2017/051631, dated Nov. 24, 2017.

* cited by examiner

VALVE FOR PRESSURIZED FLUID

CROSS REFERENCE TO RELATED APPLICATIONS

This application is a 371 of International PCT Application No. PCT/FR2017/051631, filed Jun. 20, 2017, which claims priority to French Patent Application No. 1656908, filed Jul. 20, 2016, the entire contents of which are incorporated herein by reference.

BACKGROUND

The invention relates to a valve for pressurized fluid.

The invention relates more particularly to a valve for a pressurized fluid, with or without in-built pressure regulator, comprising a body housing a fluid circuit having an upstream end intended to be placed in communication with a reserve of pressurized fluid and a downstream end intended to be placed in communication with a receiver apparatus, the circuit comprising a control member controlling the flow rate in the circuit, said flow rate control member being operated by an actuating member able to move with respect to the body of the valve, the valve comprising at least a first functional electronic member and a second functional electronic member, the second functional electronic member being mounted removably on the body of the valve.

In order to improve the functionalities of a valve for pressurized-fluid cylinder(s), it is known practice to provide electronic wireless communication and measurement members. cf. for example document FR2868160A1 which describes a modular system incorporating an electronic sensor for measuring the autonomy of a pressurized-gas reservoir.

Documents FR2991751A1 and FR2970313A1 describe modular valves.

Document FR3022972A1 describes a system of intercommunicating modular valves for pressurized-fluid cylinders.

Adapting the electronic functionalities of such valves entails providing modular mechanical and electronic elements which meet the requirements of reliability, safety and correct operation. The electrical and mechanical connections between various separable electronic members need in particular to meet these requirements.

SUMMARY

One objective of the invention is to propose a valve that has an improved modular electronic architecture.

One objective of the present invention is to mitigate all or some of the drawbacks of the prior art that are set out above.

To this end, the valve according to the invention, in other respects in accordance with the generic definition thereof given in the above preamble, is essentially characterized in that the valve comprises at least one housing intended to accommodate said second functional electronic member and an electrical contact(s) device intended to collaborate with a mating set of electrical contacts belonging to the second functional electronic member in order to provide electrical connection between the first functional electronic member and the second functional electronic member when the latter is in the position in which it is mounted on the body of the valve.

Moreover, some embodiments of the invention may include one or more of the following features:

- the second functional electronic member is capable of translational movement in a first direction with respect to the housing between a mounted position and a dismounted position in relation to the body,
- the contact(s) device of the valve is placed on a wall situated in a plane parallel to said first direction,
- the electrical contact(s) device and/or the set of electrical contacts comprises at least one of the following types of mobile electric contact: a retractable metallic track, a flexible metallic blade for potentially compensating for any play between the contacts device and the set of mating electrical contacts in a direction perpendicular to the first direction,
- at least one of the following: the electrical contact(s) device, the set of electrical contacts, comprises at least one and preferably two fixed or mobile discrete electrical contacts,
- the first functional electronic member and its electrical contact(s) device are secured to a support component mounted with the ability to move on the body of the valve between at least a first position and a second position in relation to the body,
- when the second functional electronic member is in the mounted position mounted on the body of the valve, when the support component is in the first position, the electrical contact(s) device of the valve is not in electrical contact with the mating set of electrical contacts of the second functional member; when the support component is in the second position, the electrical contact(s) device of the valve is in electrical contact with the mating set of electrical contacts of the second functional member,
- when the second functional electronic member is in the mounted position mounted on the body of the valve, the electrical contact(s) device of the valve is in electrical contact with the mating set of electrical contacts of the second functional member whatever the position of the support component,
- the support component mounted with the ability to move on the body of the valve forms an exterior casing attached to at least part of the exterior surface of the body of the valve,
- the device comprises a mounting end comprising mobile attachment members intended to collaborate with complementary attachment members to form a quick-connection system connecting the valve to another valve or to a fluid circuit, the support component with the ability to move being a member for actuating or controlling the mobile attachment members, such as a member for locking and/or unlocking the mobile attachment members,
- the first functional electronic member and the second functional electronic member each comprise at least one of the following: a wireless data reception and/or transmission device comprising an antenna, a pressure and/or temperature sensor, electronic data storage and processing logic comprising a microprocessor, a digital screen, a light source,
- when the second functional electronic member is in the mounted position mounted on the body of the valve, the actuating member is able to move between a first position in which this actuating member does not impede the movement of the second functional electronic member in relation to the body of the valve, and a second position in which the actuating member acts as a mechanical stop impeding the movement of the second functional electronic member relative to the body so as to prevent it from being dismounted in relation to the body, the second functional electronic member comprises an internal fluidic circuit comprising an upstream end and a downstream end, said internal circuit comprising at least one member for controlling the flow of fluid between the upstream and downstream ends; when the second functional electronic member is in the mounted position mounted on the body of the valve, the upstream end of the internal circuit is connected in fluidtight manner to the fluid circuit of the body of the valve so that the control member that controls the flow of fluid regulates the flow of fluid intended to be placed in communication with a fluid receiver apparatus via the downstream end of the circuit of the body or the downstream end of the internal circuit, when the second functional electronic member is in the dismounted position in relation to the body of the valve, the valve comprises a secondary fluid-control module mounted removably on the body of the valve in the housing, said secondary module having no set of electrical contacts that are the mate of the contacts device, said secondary module comprising an internal fluidic circuit having an upstream end and a downstream end, said internal circuit comprising at least one member that controls the flow of fluid between the upstream and downstream ends; in the mounted position mounted on the body of the valve in the housing, the upstream end of the internal circuit of the module is connected in fluidtight manner to the downstream end intended of the body of the valve in such a way that the member that controls the flow of fluid regulates the flow of fluid intended to be placed in communication with a fluid receiver apparatus via the downstream end of the circuit of the body or the downstream end of the internal circuit, the valve and/or the second functional electronic member comprises a piece of flexible material placed adjacent to the contact(s) to sweep across the mating contact during relative movement between said contacts, the support component comprises a tubular sleeve arranged around at least part of the body of the valve, the electrical contact(s) device of the valve (1) comprises two discrete contacts and the mating set of electrical contacts of the second functional electronic member comprises two discrete contacts, the valve is configured to detect a connected or disconnected status of the second functional member with respect to said valve according to whether there is contact or the absence of contact between the electrical contact(s) device and the mating set of electrical contacts, the valve and/or the second functional member comprises an electronic data acquisition and processing member configured to detect a connected or disconnected status of the second functional member with respect to said valve according to whether there is contact or the absence of contact between the electrical contact(s) device and the mating set of electrical contacts of the second functional member, the first functional electronic member comprises at least one of the following: a passive transponder without an electromagnetic wave generating device, an active transponder comprising an electromagnetic wave generating device, the transponder comprising an electronic read-only memory or a read-(re)write memory, with or without battery, the valve can be fluidically coupled to another valve referred to as the "basic valve", possibly secured to at least one pressurized-fluid cylinder, the valve comprising a mobile member (such as a valve driver), the movement of which is commanded by the actuating member to command the opening or closing of an isolation valve of the basic valve to which said valve is coupled removably, the actuating member comprises at least one of the following: a rotary handwheel, a push-button, a lever pivoting on the body, the electrical contacts are separated by a portion of material projecting toward the outside of the body concerned in order to avoid a short-circuit created for example by a droplet that may be situated between two adjacent contacts.

The invention may also relates to a cylinder or a collection (rack) of cylinders fitted with such a valve.

The invention may also relate to any alternative device or method comprising any combination of the features above or below.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

Figure 1:
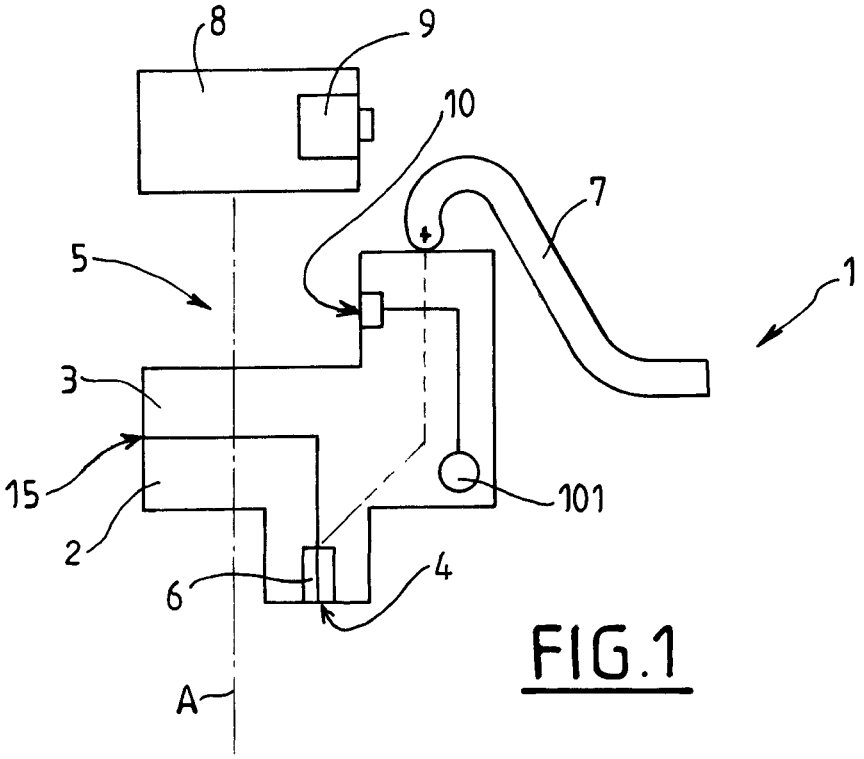
FIG. 1 depicts a schematic and partial side view illustrating one embodiment of a valve according to the invention in a dismounted position.

The valve illustrated in FIGS. 1 to 4 comprises a body 2 housing a fluid circuit 3 having an upstream end 4 intended to be placed in communication with a reserve of pressurized fluid (for example a gas cylinder or a collection of gas cylinders) and a downstream end 15 (fitted for example with a male or female outlet coupling) intended to be placed in communication with a receiver apparatus (for example an apparatus that uses the gas).

The circuit 3 comprises at least one member 6 for controlling the flow rate in the circuit 3 (control valve, flow regulator, pressure regulator, etc.). This flow control member 6 is controlled by an actuating member 7 capable of moving with respect to the body 2 of the valve 1. In the example depicted, this actuating member 7 comprises a lever pivoting on the body 2 and that can be actuated manually. Of course, as an alternative, this actuating member 7 could be a rotary handwheel, a push-button or any other appropriate mechanism (pneumatic, hydraulic, electromechanical, etc.).

Figure 2:
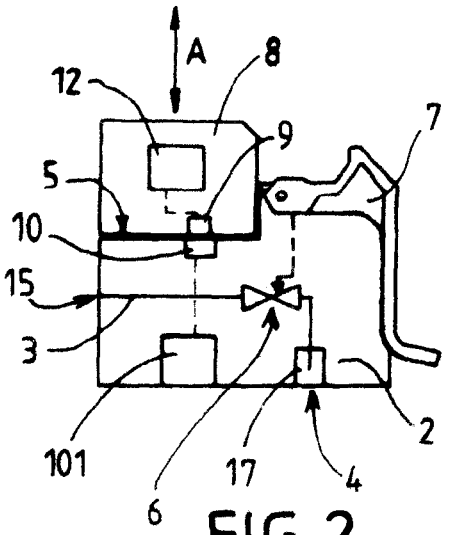
FIG. 2 depicts a schematic and partial side view illustrating another embodiment of a valve according to the invention in a mounted position and in a first configuration of use.
Figure 3:
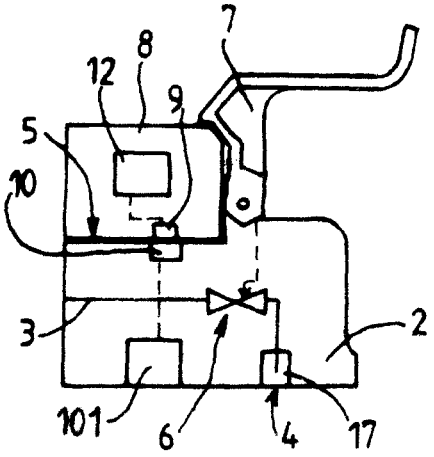
FIG. 3 depicts a view similar to that of FIG. 2, in which the valve is in a second configuration of use.
Figure 4:
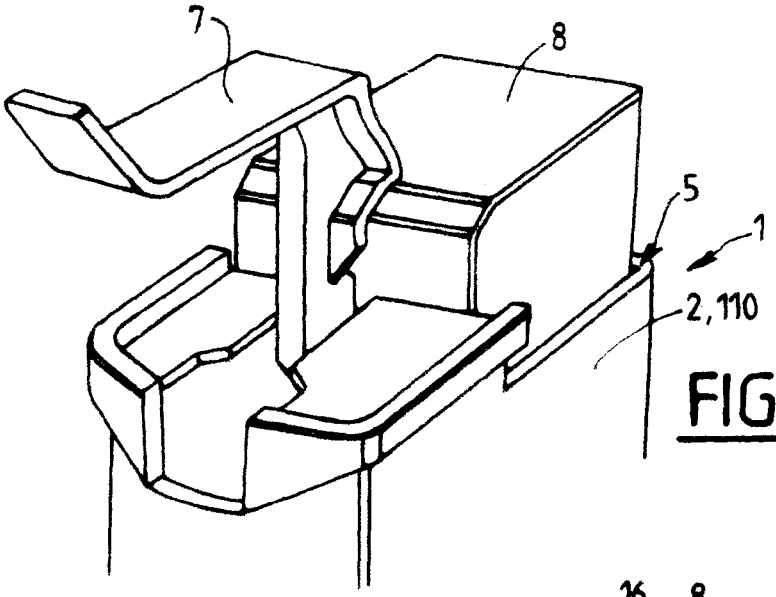
FIG. 4 depicts a schematic and partial perspective view of a detail of the valve of FIG. 2.

The member 6 controlling flow rate in the circuit 3 depicted schematically in FIGS. 2 and 3 comprises a control valve 6 but any other flow control member could be envisioned. For example, as an alternative or in combination, the valve could comprise a component capable of moving such as a valve driver the movement of which is commanded by the actuating member 7 (cf. FIG. 1). This valve driver, which for example is capable of translational movement, may be intended for example to actuate (notably to open) a system of valve elements situated on another valve to which the valve connects in order to withdraw or transfer pressurized fluid.

The valve 1 comprises at least a first functional electronic member 101 and a second functional electronic member 8 which are configured to collaborate, which is to say for example to transmit information and/or an electrical signal to one another. The second functional electronic member 8 is mounted removably on the body 2 of the valve and may comprise at least one electronic member 12 such as a configured electronic data acquisition and processing device, a wireless data communication device, etc.

To this end, the valve 1 comprises at least one housing 5 comprising an end wall and intended to accommodate the second functional electronic member 8 and an electrical contact(s) device 10 intended to collaborate with a mating set of electrical contacts 9 belonging to the second functional electronic member 8. These contacts 9, 10 are intended to provide an electrical connection between the first functional electronic member 101 and the second functional electronic member 8 when the latter is in the mounted position mounted on the body 2 of the valve.

These two functional electronic members 8, 101 may each comprise at least one of the following: a wireless data reception and/or transmission device comprising an antenna, a pressure sensor, a temperature sensor, electronic data storage and processing logic comprising a microprocessor, a digital screen, a light source, etc.

In particular, the first functional electronic member 101 may comprise a data medium such as, for example: a passive transponder without an electromagnetic wave generating device, an active transponder comprising an electromagnetic wave generating device, the transponder comprising an electronic read-only memory or a read-(re)write memory, with or without battery.

In this way, when the second functional electronic member 8 is correctly mounted on the body 2 of the valve, a physical electrical link is established that allows data or energy for example to be transmitted.

For example, the second functional electronic member 8 is capable of translational movement in a first direction A with respect to the housing 5 between a mounted position (FIGS. 2 and 3) and a dismounted position (FIG. 1) in relation to the body 2. For example, this first direction A is vertical when the valve 1 is in the configuration of use (at the top of a gas cylinder standing vertically for example).

The contact(s) device 10 of the valve 1 is, for example, positioned on a wall situated in a plane parallel to said first direction A. What that means to say is that the contacts 9, 10 between the valve 1 and the second functional member 8 come to face one another on each side of a vertical plane (cf. FIG. 1). This achieves electrical contact only when the second functional electronic member 8 is correctly positioned in the housing 5 of the body 2 in this direction A.

Of course, as an alternative or in combination, the adjacent contacts 9, 10 may be positioned in two horizontal planes (which are perpendicular to the vertical direction, cf. FIG. 3, for example, at the end wall of the housing).

Figure 6:
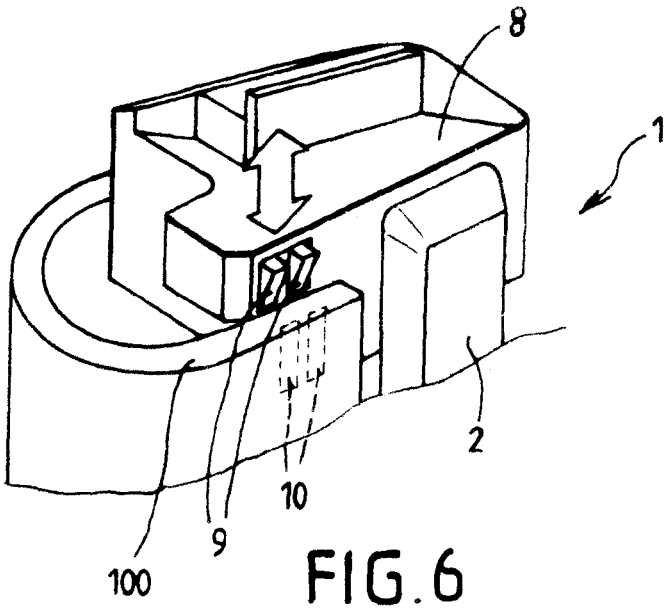
FIG. 6 depicts a schematic and partial perspective view of a detail of a valve according to another embodiment, illustrating a system of electrical contacts of the valve.
Figure 7:
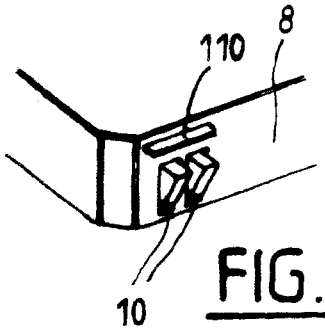
FIG. 7 depicts a schematic and partial perspective view of a detail of a valve and illustrates another embodiment of a system of electrical contacts of the valve.
Figure 8:
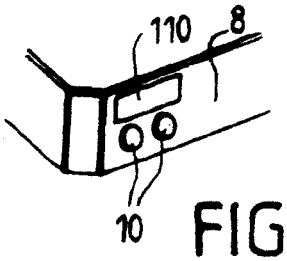
FIG. 8 depicts a schematic and partial perspective view of a detail of a valve and illustrates another embodiment of a system of electrical contacts of the valve.

As illustrated in FIGS. 6 to 8, the electrical contact(s) device 10 may be made up of two fixed or mobile discrete electrical contacts collaborating with two mating discrete contacts 9 on the second electronic member 8. These electrical contacts 9 comprise for example one of the following, a projecting or non-projecting, fixed or retractable metallic track, a flexible metallic blade, etc.

In addition, as illustrated in FIGS. 7 and 8, the valve 1 and/or the second member 8 may comprise a piece 110 of flexible material (wiper, tongue, etc.) positioned adjacent to the contacts (9 or 10) in order to "sweep" across the mating contact 10, 9 opposite on the occasion of relative movement between said contacts 9, 10 (when the two entities are being connected and/or disconnected). This notably makes it possible to improve the quality of the contacts 10 on the valve (these contacts 10 potentially remain exposed to the exterior environment).

Figure 10:
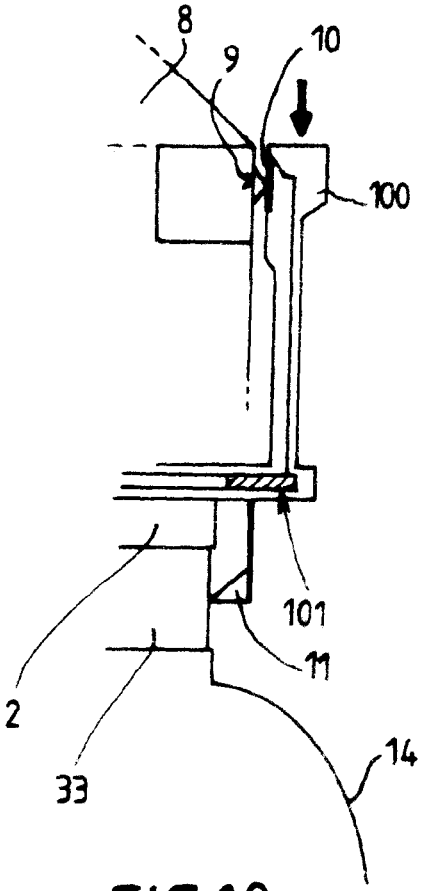
FIG. 10 depicts a schematic and partial cross-sectional view of a detail of a valve of FIG. 6 illustrates a configuration of use of the system of electrical contacts of the valve.
Figure 9:
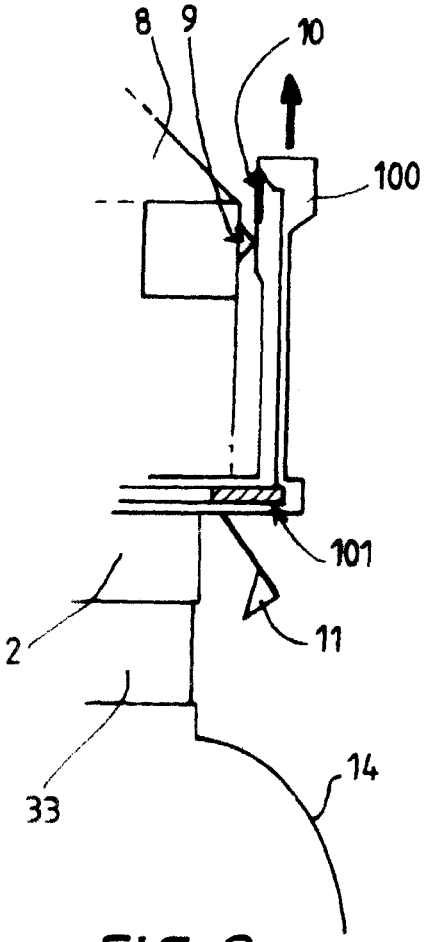
FIG. 9 depicts a schematic and partial cross-sectional view of a detail of a valve of FIG. 6 and illustrates a configuration of use of the system of electrical contacts of the valve.

As illustrated in the alternative form of embodiment of FIGS. 9 and 10, the first functional electronic member 101 and its associated electrical contacts device 10 may be secured to a support component 100 mounted with the ability to move on the body 2 of the valve 1. This component 100 is able to move, for example translationally and/or rotationally, between at least a first position and a second position relative to the body. For example, this mobile component 100 is able to be moved translationally in a direction parallel to the first direction A.

For example, when the second functional electronic member 8 is in the mounted position mounted on the body 2 of the valve, when the support component 100 is in the first position, the electrical contacts device 10 of the valve 1 is not in electrical contact with the mating set 9 of electrical contacts belonging to the second functional member 8 (cf. FIG. 9). By contrast, when the support component 100 is in the second position, the electrical contacts device 10 of the valve 1 is in electrical contact with the mating set 9 of electrical contacts belonging to the second functional member 8 (cf. FIG. 10).

What that means to say is that the moving of the mobile component 100 (for example manually by the user) acts like a switch which either connects or does not connect the mating contacts 9, 10. The valve 1 and/or its electronic member 8 may notably be configured to detect a connected or disconnected status of the second functional member 8 with respect to said valve 1 according to whether there is contact or the absence of contact between the electrical contact(s) device 10 and the mating set 9 of electrical contact(s).

For example, the support component 100 is able to move on the body 2 of the valve 1 and forms an exterior casing attached to at least part of the exterior surface of the body 2 of the valve (cf. FIG. 6). The support component 100 for example comprises a tubular sleeve arranged around at least part of the body 2 of the valve.

This support component 100 may where appropriate perform another function on the valve. For example, the body 2 of the valve comprises a mounting end (notably a lower end) comprising mobile attachment members 11 intended to collaborate with complementary attachment members to form a quick-connection system for connecting the valve 1 to another valve 13 or to a fluid circuit. This mobile support component 100 may be an actuating member for actuating the mobile attachment members 11, such as a member for locking and/or unlocking the mobile attachment members 11 (according to the position of the support component 100).

Schematically indicated in FIGS. 9 and 10, the body 2 of the valve may be able to be coupled fluidically and removably to another valve 33 referred to as the "basic valve". This basic valve 33 is secured for example to at least one cylinder of pressurized fluid. The valve 1 for example comprises a mobile element (such as a valve driver 6, cf. FIG. 1) the movement of which is commanded by the actuating member 7 in order to command the opening or the closing of an isolation valve element of the basic valve 33 to which said valve 1 is removably coupled.

Figure 11:
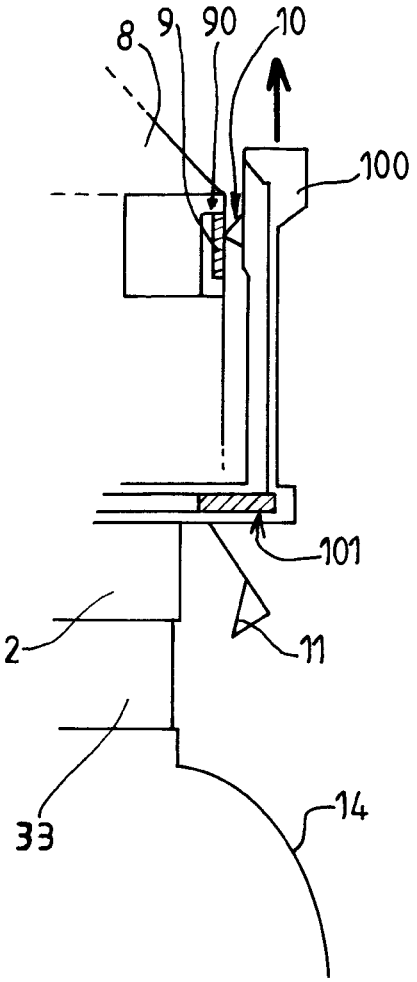
FIG. 11 depicts a view similar to FIGS. 9 and 10 illustrating an alternative form of embodiment of the system of electrical contacts of the valve.
Figure 12:
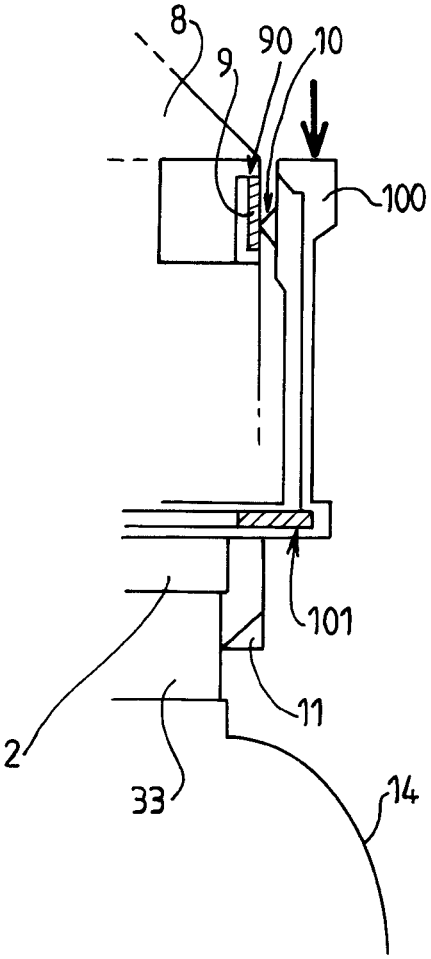
FIG. 12 depicts a view similar to FIGS. 9 and 10 illustrating an alternative form of embodiment of the system of electrical contacts of the valve.

The alternative form of embodiment in FIGS. 11 and 12 differs from FIGS. 9 and 10 in that the second functional member 8 comprises a set of electrical contacts 9 is projecting and/or able to move in a direction transverse to the first direction A and the support component 100 of the valve comprises a planar contacts device 10 (for example longitudinal tracks). In addition, whatever the position of the support component 100 relative to the second functional member 8, electrical connection between these two elements 9, 10 is achieved.

Figure 13:
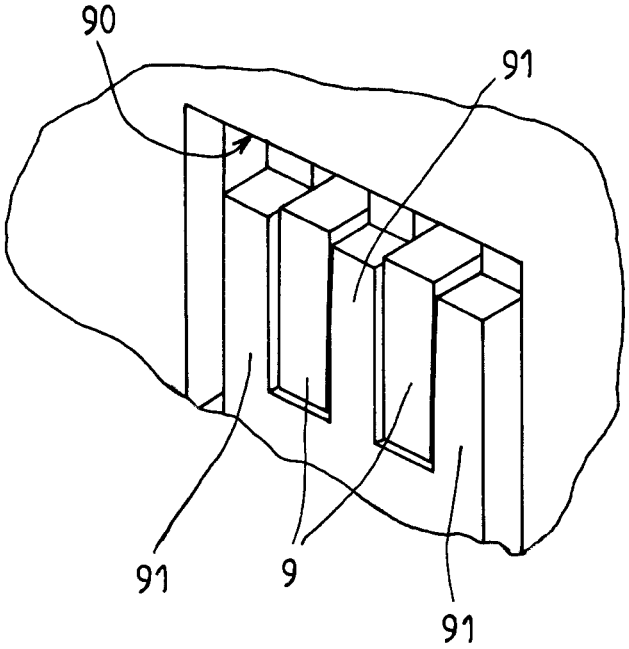
FIG. 13 depicts a perspective view of a detail of one embodiment of the set of electrical contacts of the embodiment of FIGS. 11 and 12.

In addition, as visible in FIGS. 11 to 13, the set of electrical contacts 9 may be sheltered under a lip 90 that limits their exposure to rain or moisture (descending vertically for example in a direction parallel to the direction A). Likewise, as visible in FIG. 13, the two contacts 9 may also be set back toward the inside of the second functional member 8. What this means to say is that the contacts 9 are set back in relation to the portion of material 91 which surrounds them and the contacts device 10 of the support component 100 thus comes toward the inside of the functional member 8 in order to achieve electrical contact. In more general terms, the contacts 9 may be separated by a portion of material 91 projecting toward the outside of the bodies concerned in order to avoid a short-circuit created for example by a droplet that may be situated between two adjacent contacts 9.

According to one optional possible particular feature (potentially independent of the electrical connection structure), when the second functional electronic member 8 is in the mounted position mounted on the body 2 of the valve, the actuating member 7 may mechanically block the second functional member 8 on the body 2 of the valve 1.

For example, the actuating member 7 is able to move between a first position in which it does not impede the movement of the second functional electronic member 8 in relation to the body 2 of the valve 1 (cf. FIG. 2), and a second position in which the actuating member 7 acts as a mechanical stop impeding the movement of the second functional electronic member 8 relative to the body 2 so as to prevent it from being dismounted in relation to the body 2 (cf. FIG. 3). For example, the actuating member 7 comprises a shape designed to fit to or block the exterior shape of the second functional member 8. This for example makes it possible to prevent unwanted disconnection of this member 8 when the valve is under pressure.

Figure 5:
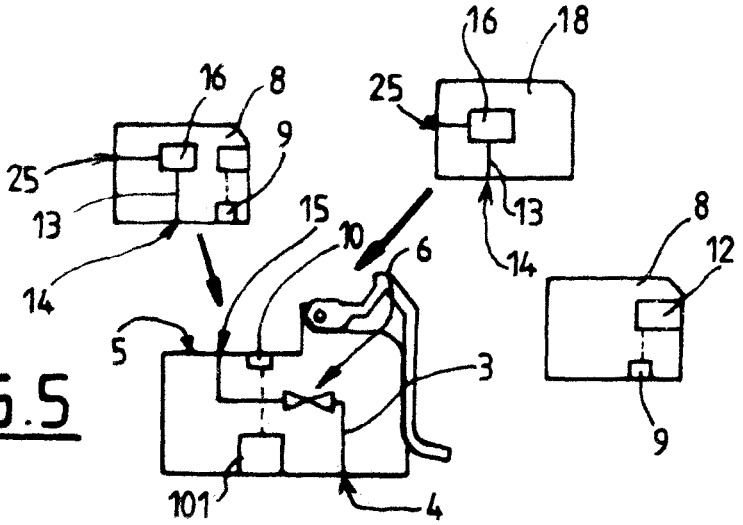
FIG. 5 depicts a schematic and partial side view illustrating another embodiment of a valve according to the invention.

This is particularly advantageous for the embodiment described in FIG. 5. Specifically, the second functional electronic member 8 also preferably has a function of regulating or controlling the flow of fluid supplied by the valve 1, which means to say that the second member 8 may be supplied with the pressurized fluid coming from the circuit 3 of the valve 1.

For example, this second functional electronic member 8 comprises an internal fluid circuit 13 comprising an upstream end 14 and a downstream end 25. This internal circuit 13 comprises at least one member 16 for controlling the flow of fluid between the upstream end 14 and downstream end 25. When the second functional electronic member 8 is in the mounted position mounted on the body 2 of the valve, the upstream end 14 of this internal circuit 13 is coupled in fluidtight manner to the downstream end 15 of the fluid circuit 3 of the body 2 of the valve. The downstream end 25 of the internal circuit 13 of the second functional member 8 may form an outlet intended to be placed in communication with a fluid receiver apparatus. As an alternative, the end of the internal circuit 13 of the second functional member 8 could be coupled once again to the fluid circuit 3 of the body 2 of the valve. This circuit 3 would then comprise a fluid outlet coupling at one of its ends. What that means to say is that the fluid passes through the second functional member 8 before returning to the circuit 3 of the body 2 of the valve.

When the second functional electronic member 8 is in the dismounted position dismounted from the body 2 of the valve 1 (in the event of failure of the electronic member 8), the valve can use another fluid control module 18 mounted removably on the body 2 of the valve in the housing 5.

This "backup" control module 18 (or secondary module) may be of solely mechanical type, which is to say not provided with a set 9 of electrical contacts that are the mate of the contacts device 10. This control module 18 may, as previously, comprise an internal fluidic circuit 13 having an upstream end 14 and a downstream end 25. This internal circuit 13 for example comprises at least one member 16 for controlling the flow of fluid between the upstream 14 and downstream 25 ends (system involving calibrated orifice(s) or some other system). In the mounted position mounted on the body 2 of the valve in the housing 5, the upstream end 14 of this internal circuit 13 of the control module 18 is coupled in fluidtight manner to the downstream end 15 intended of the body 2 of the valve. The downstream end 25 of this internal circuit 13 of the control module 18 may thus form a fluid outlet intended to be placed in communication with a fluid receiver apparatus. As previously, as an alternative, the "backup" control module 18 may comprise an internal circuit 13 which sends the fluid into the circuit 3 of the body 2 of the valve after it has passed through the control member 16. What that means to say is that the fluid passes through the second functional member 8 before returning to the circuit 3 of the body 2 of the valve.

This "backup" control module 18 preferably constitutes protection (cover, protective screen or equivalent) for the contacts device 10.

Thus, as depicted in FIG. 5, the body 2 of the valve may equally well collaborate:

with a removable module 8 comprising only electronic members 12 and functions (and therefore having electrical contact(s) 9), or with a module 18 comprising only mechanical members 16 (and therefore having no electrical contact(s) 9), or with a module comprising mechanical and electronic members (and therefore having no electrical contact(s) 9).

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

The invention claimed is:

1. A valve for a pressurized fluid, comprising a body comprising a fluid circuit comprising an upstream end configured to be placed in communication with a reserve of pressurized fluid and a downstream end configured to be placed in communication with a receiver apparatus, the circuit comprising a control member controlling the flow rate in the circuit, said flow rate control member being operated by a mobile actuating member configured to move relative to the body of the valve, the valve comprising at least a first functional electronic member and a second functional electronic member, the second functional electronic member being mounted removably on the body of the valve, wherein the valve comprises at least one housing configured to accommodate said second functional electronic member and the at least one housing comprising an electrical contact(s) device configured to collaborate with a mating set of electrical contacts belonging to the second functional electronic member in order to provide electrical connection between the first functional electronic member and the second functional electronic member when the latter is in the position in which it is mounted within the housing, wherein the second functional electronic member is configured to move translationally in a first direction with respect to the housing between a mounted position and a dismounted position in relation to the body.

2. The valve as claimed in claim 1, wherein the contact(s) device of the valve is placed on a wall of the housing situated in a plane parallel to said first direction.

3. The valve as claimed in claim 1, wherein the electrical contact(s) device and/or the set of electrical contacts comprises at least one of the following types of mobile electric contact: a retractable metallic track, a flexible metallic blade for potentially compensating for any play between the contacts device and the set of mating electrical contacts in a direction perpendicular to the first direction.

4. The valve as claimed in claim 1, wherein the first functional electronic member and the electrical contact(s) device are secured to a support component mounted with the ability to move on the body of the valve between at least a first position and a second position in relation to the body, wherein when the second functional electronic member is in the mounted position mounted on the body of the valve, when the support component is in the first position, the electrical contact(s) device of the valve is not in electrical contact with the mating set of electrical contacts of the second functional member, and in that when the support component is in the second position, the electrical contact(s) device of the valve is in electrical contact with the mating set of electrical contacts of the second functional member.

5. The valve as claimed in claim 1, wherein the first functional electronic member and the electrical contact(s) device are secured to a support component mounted with the ability to move on the body of the valve between at least a first position and a second position in relation to the body, wherein when the second functional electronic member is in the mounted position mounted on the body of the valve, the electrical contact(s) device of the valve is in electrical contact with the mating set of electrical contacts of the second functional member whatever the position of the support component.

6. The valve as claimed in claim 1, wherein the first functional electronic member and the electrical contact(s) device are secured to a support component mounted with the ability to move on the body of the valve between at least a first position and a second position in relation to the body, wherein the support component mounted with the ability to move on the body of the valve forms an exterior casing attached to at least part of the exterior surface of the body of the valve.

7. The valve as claimed in claim 1, further comprising a mounting end comprising mobile attachment members configured to collaborate with complementary attachment members to form a quick-connection system connecting the valve to another valve or to a fluid circuit, and wherein the support component configured to move is a member for actuating or controlling the mobile attachment members.

8. The valve as claimed in claim 1, wherein the first functional electronic member and the second functional electronic member each comprise at least one of the following: a wireless data reception and/or transmission device comprising an antenna, a pressure and/or temperature sensor, electronic data storage and processing logic comprising a microprocessor, a digital screen, a light source.

9. The valve as claimed in claim 1, wherein when the second functional electronic member is in the mounted position mounted on the body of the valve, the actuating member is able to move between a first position in which this actuating member does not impede the movement of the second functional electronic member in relation to the body of the valve, and a second position in which the actuating member acts as a mechanical stop impeding the movement of the second functional electronic member relative to the body to prevent it from being dismounted in relation to the body.

10. The valve as claimed in claim 1, wherein the second functional electronic member comprises an internal fluidic circuit comprising an upstream end and a downstream end, said internal circuit comprising at least one member for controlling the flow of fluid between the upstream and downstream ends;

when the second functional electronic member is in the mounted position mounted on the body of the valve, the upstream end of the internal circuit is connected in fluidtight manner to the fluid circuit of the valve body so that the control member that controls the flow of fluid regulates the flow of fluid intended to be placed in communication with a fluid receiver apparatus via the downstream end of the circuit of the body or the downstream end of the internal circuit.

11. The valve as claimed in claim 1, wherein when the second functional electronic member is in the dismounted position in relation to the body of the valve, the valve comprises a secondary fluid-control module mounted removably on the body of the valve in the housing, said secondary module having no set of electrical contacts that are the mate of the contacts device, said secondary module comprising an internal fluidic circuit having an upstream end and a downstream end, said internal circuit comprising at least one member that controls the flow of fluid between the upstream and downstream ends; in the mounted position mounted on the body of the valve in the housing, the upstream end of the internal circuit of the module is connected in fluidtight manner to the downstream end intended of the body of the valve in such a way that the member that controls the flow of fluid regulates the flow of fluid intended to be placed in communication with a fluid receiver apparatus via the downstream end of the circuit of the body or the downstream end of the internal circuit.

* * * * *